US011187184B2

(12) United States Patent
Rabhi

(10) Patent No.: US 11,187,184 B2
(45) Date of Patent: Nov. 30, 2021

(54) ARTICULATED PLENUM FOR TRANSFER-EXPANSION-REGENERATION COMBUSTION ENGINE

(71) Applicant: Vianney Rabhi, Lyons (FR)

(72) Inventor: Vianney Rabhi, Lyons (FR)

( * ) Notice: Subject to any disclaimer, the term of this patent is extended or adjusted under 35 U.S.C. 154(b) by 0 days.

(21) Appl. No.: 16/833,095

(22) Filed: Mar. 27, 2020

(65) Prior Publication Data

US 2020/0309064 A1 Oct. 1, 2020

Related U.S. Application Data

(60) Provisional application No. 62/828,194, filed on Apr. 2, 2019.

(30) Foreign Application Priority Data

Mar. 29, 2019 (FR) ..... 1903385

(51) Int. Cl.
*F02G 1/05* (2006.01)
*F02G 1/057* (2006.01)
*F02G 1/053* (2006.01)

(52) U.S. Cl.
CPC ..... *F02G 1/05* (2013.01); *F02G 1/057* (2013.01); *F02G 1/0535* (2013.01)

(58) Field of Classification Search
CPC ..... F02G 1/05; F02G 1/057; F02G 1/0535; F02G 1/055; F02G 3/02; F02G 2254/20; F02G 2250/03; F02G 2254/10
See application file for complete search history.

(56) References Cited

U.S. PATENT DOCUMENTS 4,004,421 A * 1/1977 Cowans ..... F02G 1/02 60/516
4,827,882 A * 5/1989 Paul ..... F02B 29/00 123/292
5,540,191 A * 7/1996 Clarke ..... F02B 47/02 123/25 C
6,463,731 B1 * 10/2002 Warren ..... F02C 7/08 60/39.6
9,982,626 B2 * 5/2018 Rabhi ..... F02G 1/0535
2009/0266337 A1 * 10/2009 Rabhi ..... F01B 9/047 123/48 B
2010/0058923 A1 * 3/2010 Green ..... F01B 3/0094 91/480
2010/0218745 A1 * 9/2010 Rabhi ..... F16K 11/056 123/48 B (Continued)

FOREIGN PATENT DOCUMENTS

FR 3032236 A1 8/2016
WO 2016/120560 A2 8/2016

(Continued)

*Primary Examiner* — Shafiq Mian
(74) *Attorney, Agent, or Firm* — Nixon & Vanderhye

(57) ABSTRACT

The articulated plenum (1) forms an intake pipe (3) which is ended with tight ball joint links (16) held by restraining means (17), said plenum (1) connecting a heat source (39) to an expansion cylinder (32) and including a plenum inlet orifice (4), a plenum outlet orifice (6) which receives a valve seat (9), and an actuator orifice (8) which receives an intake valve actuator (50) which controls a valve (10), the latter engaging with the valve seat (9) to close the intake pipe (3).

8 Claims, 3 Drawing Sheets

(56) References Cited

U.S. PATENT DOCUMENTS

| | | | | |
|---|---|---|---|---|
| 2016/0252048 | A1* | 9/2016 | Rabhi | F02G 1/05 123/25 A |
| 2017/0234215 | A1* | 8/2017 | Schwenck | F01B 9/047 123/48 B |
| 2018/0245538 | A1* | 8/2018 | Rabhi | F02G 1/055 |

FOREIGN PATENT DOCUMENTS

| | | | |
|---|---|---|---|
| WO | 2017/046479 | A1 | 3/2017 |
| WO | 2018/154214 | A1 | 8/2018 |
| WO | 2019/069000 | A1 | 4/2019 |

* cited by examiner

ARTICULATED PLENUM FOR TRANSFER-EXPANSION-REGENERATION COMBUSTION ENGINE

CROSS-REFERENCE TO RELATED APPLICATIONS

Field of the Invention

The present invention relates to an articulated plenum particularly intended to enhance the transfer-expansion-regeneration combustion engine according to patent WO2016/120560 held by the applicant, said patent resulting from the French patent published on Aug. 5, 2016 under No. FR 3032236.

BACKGROUND OF THE INVENTION

Description of the Related Art

More specifically, the articulated plenum according to the present invention can be advantageously combined with the dual-acting expansion cylinder with adaptive support according to patent WO2017/046479 also held by the applicant.

Patent WO2017/046479 enables the rigid assembly formed of a cylinder barrel, a lower cylinder head and an upper cylinder head comprised in the transfer-expansion-regeneration combustion engine according to patent WO2016/120560 to expand freely under the effect of temperature relative to a transmission casing whereon it is attached, without compromising the proper functioning of a piston moving in said cylinder barrel.

Besides patents WO2016/120560 and WO2017/046479, the articulated plenum according to the present invention is of particular interest in combination with the invention according to patent WO2018/154214, which consists of a regenerative cooling system. Said system—which also enhances the transfer-expansion-regeneration combustion engine according to patent WO2016/120560—is particularly suitable for manufacturing the rigid assembly formed of the cylinder barrel, lower cylinder head and upper cylinder head of said engine made of cast iron or stainless steel, because said system is suitable for keeping said assembly at a maximum temperature of the order of seven hundred degrees Celsius which remains compatible with these materials.

The articulated plenum according to the present invention is also advantageously combined with the subject matter of French patent application No. 1759206 of Oct. 2, 2017 held by the applicant. This application describes a hydraulic regeneration valve actuator which advantageously applies to the transfer-expansion-regeneration combustion engine according to patent WO2016/120560, preferably in the version thereof enhanced by the subject matter of patent WO2017/046479.

French patent application No. 1759206 particularly describes that the lower expansion cylinder head and the upper expansion cylinder head can each receive actuator cartridges which are pressed—via plate abutments on the cylinder head with which they engage—by, on one hand, a lower cartridge restraining plate in the case of the lower expansion cylinder head and by, on the other, an upper cartridge restraining plate in the case of the upper expansion cylinder head, said plates tending to be moved closer to one another by plate tie rods.

However, patent WO2017/046479 and French patent application No. 1759206 suggest that the intake pipes of the transfer-expansion-regeneration engine conveying high-temperature gases are integrated in the lower and upper cylinder head of said engine, which are advantageously made—according to patent WO2018/154214—of cast iron or stainless steel kept at a temperature of the order of seven hundred degrees Celsius.

It is noted that it would be advantageous that the intake pipes of the transfer-expansion-regeneration engine be capable of being brought to a higher temperature as they convey high-temperature gases that it is necessary to avoid cooling. Obviously, this temperature should be as close as possible to that of said gases, i.e. for example one thousand three hundred degrees Celsius. Indeed, if the temperature of said pipes is equivalent to that of the gases conveyed therein, said gases cannot transfer heat to said pipes. Minimizing the transfer of heat between gases and pipes is favorable for the final energy efficiency of the transfer-expansion-regeneration engine.

It is also noted that patent WO2017/046479 indeed enables the rigid assembly formed of the cylinder barrel, lower cylinder head and upper cylinder head of the transfer-expansion-regeneration engine to expand freely in relation to the transmission casing whereon it is attached. However, said patent does not specify how the intake pipes of said engine are connected to the heat source thereof which may for example consist of a burner. However, the distance between the respective intake pipes of the lower and upper cylinder heads of said engine is liable to vary significantly due to the expansion of the rigid assembly formed of the cylinder barrel, lower cylinder head and upper cylinder head.

Similarly, French patent application No. 1759206 which describes a hydraulic regeneration valve actuator envisages an actuator cartridge which is mounted on the expansion cylinder assembly of the transfer-expansion-regeneration combustion engine, said cartridge including a valve cage housed either in the lower expansion cylinder head, or in the upper expansion cylinder head. In this context, the valve which is suitable for opening or closing the intake pipe can be guided directly or indirectly in said cage which accommodates a valve seat, the latter and/or the part of the valve cage guiding said valve being suitable for being cooled by a valve cooling circuit wherein a heat transfer fluid circulates.

The cage thus kept at a low temperature offers a heat exchange surface area for the gases circulating in the intake pipe which are brought to a high temperature. This configuration thus favors the cooling of said gases and, therefore, adversely affects the final energy efficiency of the transfer-expansion-regeneration motor.

On the basis of these observations and to correct the inherent drawbacks of the various inventions and combinations of inventions described above, the articulated plenum according to the present invention is suitable for:

Mechanically uncoupling, in a tight manner, and along the three axes of the three-dimensional Cartesian coordinate system, the intake pipes of the transfer-expansion-regeneration engine in relation to the lower or upper cylinder head with which they engage, on one hand, and, in relation to the heat source, on the other, so that the rigid assembly formed of the cylinder barrel, lower cylinder head and upper cylinder head of said engine, on one hand, and the heat source, on the other, can expand freely in relation to one another without said intake pipes preventing them, and without stressing said pipes mechanically;

Making the intake pipes of the transfer-expansion-regeneration engine in a material compatible with high temperatures, said material optionally advantageously being different from that forming the cylinder barrel and the lower and upper cylinder heads of said engine, this strategy helping minimize the cooling of the hot gases circulating in said intake pipes;

Receiving, containing and thermally and tightly insulating an actuator cartridge similar to that described in French patent application No. 1759206, without using a valve cage which is liable to cool the hot gases circulating in said intake pipes;

Housing an intake valve operating at high temperature, which helps minimize the cooling of the hot gases circulating in said intake pipes;

Enabling the intake valve to remain fully operational and tight regardless of the relative position of the actuator cartridge which controls said valve in relation to the intake pipe, said position being variable according to the expansion of said valve in relation to that of said cartridge, and in relation to that of said intake pipe.

BRIEF SUMMARY OF THE INVENTION

It is understood that the articulated plenum according to the invention is primarily intended for the transfer-expansion-regeneration combustion engine according to patent WO2016/120560 held by the applicant.

However, said plenum may also be applied without restriction to any gas pipe brought to a high temperature, the opening and closing of said pipe being controlled by a valve, and said pipe interconnecting components suitable for expanding and moving in relation to one another.

The other features of the present invention have been described in the description and in the subclaims directly or indirectly dependent on the main claim.

The articulated plenum according to the present invention is envisaged for a transfer-expansion-regeneration combustion engine wherein the dual-acting expansion piston moves in an expansion cylinder, the latter forming with an upper expansion cylinder head and a lower expansion cylinder head an expansion cylinder-head assembly, said engine comprising a compressor which compresses a working gas before expelling same into a regeneration heat exchanger wherein said gas is preheated whereas on leaving said exchanger said gas is superheated by a heat source before being introduced—via a burner outlet pipe followed by an intake pipe and by an intake valve controlled by an intake valve actuator—into the expansion cylinder in order to be expanded therein and produce work on a power output shaft, said gas being subsequently expelled from the expansion cylinder prior to being reintroduced into the regeneration heat exchanger in order to be cooled therein by transferring a portion of the heat thereof to the working gas entering said exchanger to be preheated therein, said plenum comprising:

A hollow plenum body forming the intake pipe and comprising a plenum inlet orifice which communicates with the heat source, a plenum outlet orifice which opens into the expansion cylinder via either the upper expansion cylinder head or the lower expansion cylinder head, and an actuator orifice which receives the intake valve actuator;

A frusto-spherical end on the burner side provided at the level of the plenum inlet orifice, said end forming a tight ball joint link with a complementary frusto-spherical surface on the burner side provided outside the burner outlet pipe;

A frusto-spherical end on the cylinder head side provided at the level of the plenum outlet orifice, said end forming a tight ball joint link with a complementary frusto-spherical surface on the cylinder head side provided outside the upper expansion cylinder head or the lower expansion cylinder head;

A valve seat provided in the vicinity of the plenum outlet orifice, the intake valve being capable of resting on said seat to close said orifice;

Restraining means which, on one hand, keep the frusto-spherical end on the burner side pressed against the complementary frusto-spherical surface on the burner side, and which, on the other, keep the frusto-spherical end on the cylinder head side pressed against the complementary frusto-spherical surface on the cylinder head side.

The articulated plenum according to the present invention comprises a valve seat which has a complementary frusto-spherical surface on the seat side which engages with a frusto-spherical bearing area on the valve side provided at the end of the intake valve, said surface and said bearing area forming a tight ball joint link when they are in contact with one another.

The articulated plenum according to the present invention comprises an intake valve which comprises a valve stem which can move in translation along the longitudinal axis thereof in or with an upper valve stem guiding ball joint housed in the intake valve actuator, said ball joint enabling said valve to orient itself according to a limited angle in relation to said actuator.

The articulated plenum according to the present invention comprises a valve stem which can move in translation along the longitudinal axis thereof in a position-memory valve stem seal-carrier which is housed in the intake valve actuator, said seal-carrier being capable of moving radially in relation to said actuator and including a valve stem seal which forms tightness between said seal-carrier and the valve stem whereas said seal-carrier also includes a seal-carrier seal which forms tightness between said seal-carrier and the intake valve actuator.

The articulated plenum according to the present invention comprises a position-memory valve stem seal-carrier which is kept pressed against the intake valve actuator by a valve stem seal-carrier spring.

The articulated plenum according to the present invention comprises a plenum body which receives the intake valve actuator via a thermal decoupling spacer which produces tightness and centering with the plenum body, on one hand, and with the intake valve actuator, on the other.

The articulated plenum according to the present invention comprises restraining means consisting of at least one actuator restraining plate kept pressed against the intake valve actuator by at least one plate tie rod and via at least one plate abutment, such that said actuator is in turn kept pressed against the plenum body via an actuator bearing face contained in the actuator orifice, and such that the frusto-spherical end on the burner side is kept pressed against the complementary frusto-spherical surface on the burner side and/or the frusto-spherical end on the cylinder head side is kept pressed against the complementary frusto-spherical surface on the cylinder head side.

The articulated plenum according to the present invention comprises restraining means which consist of at least one plenum restraining vise on the burner side which presses directly or indirectly—in the vicinity of the plenum inlet orifice and in the direction thereof—on the plenum body via at least one vise bearing surface.

BRIEF DESCRIPTION OF THE DRAWINGS

The following description with regard to the appended drawings given by way of non-limiting examples will make it possible to better understand the invention, the features thereof, and the advantages that it is liable to provide.

DESCRIPTION OF THE INVENTION

Figure 1:
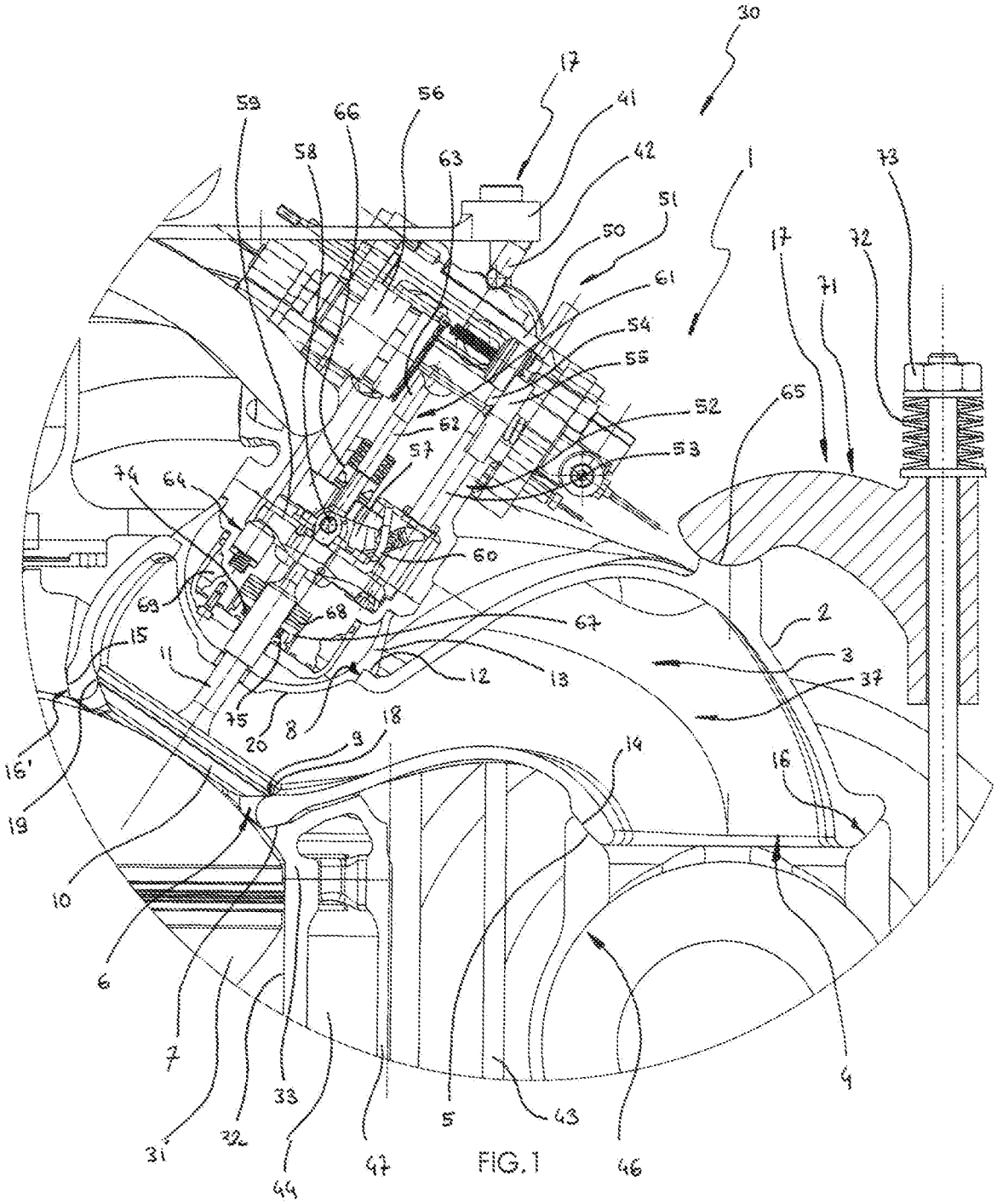
FIG. 1 is a schematic cross-sectional view of the articulated plenum according to the invention, used on the transfer-expansion-regeneration combustion engine according to patent WO2016/120560 held by the applicant, said plenum accommodating a hydraulic regeneration valve actuator wherein the valve is rendered compatible with said plenum by various arrangements envisaged by the articulated plenum according to the invention, a plenum restraining vise on the burner side being mounted being shown by way of restraining means.
Figure 2:
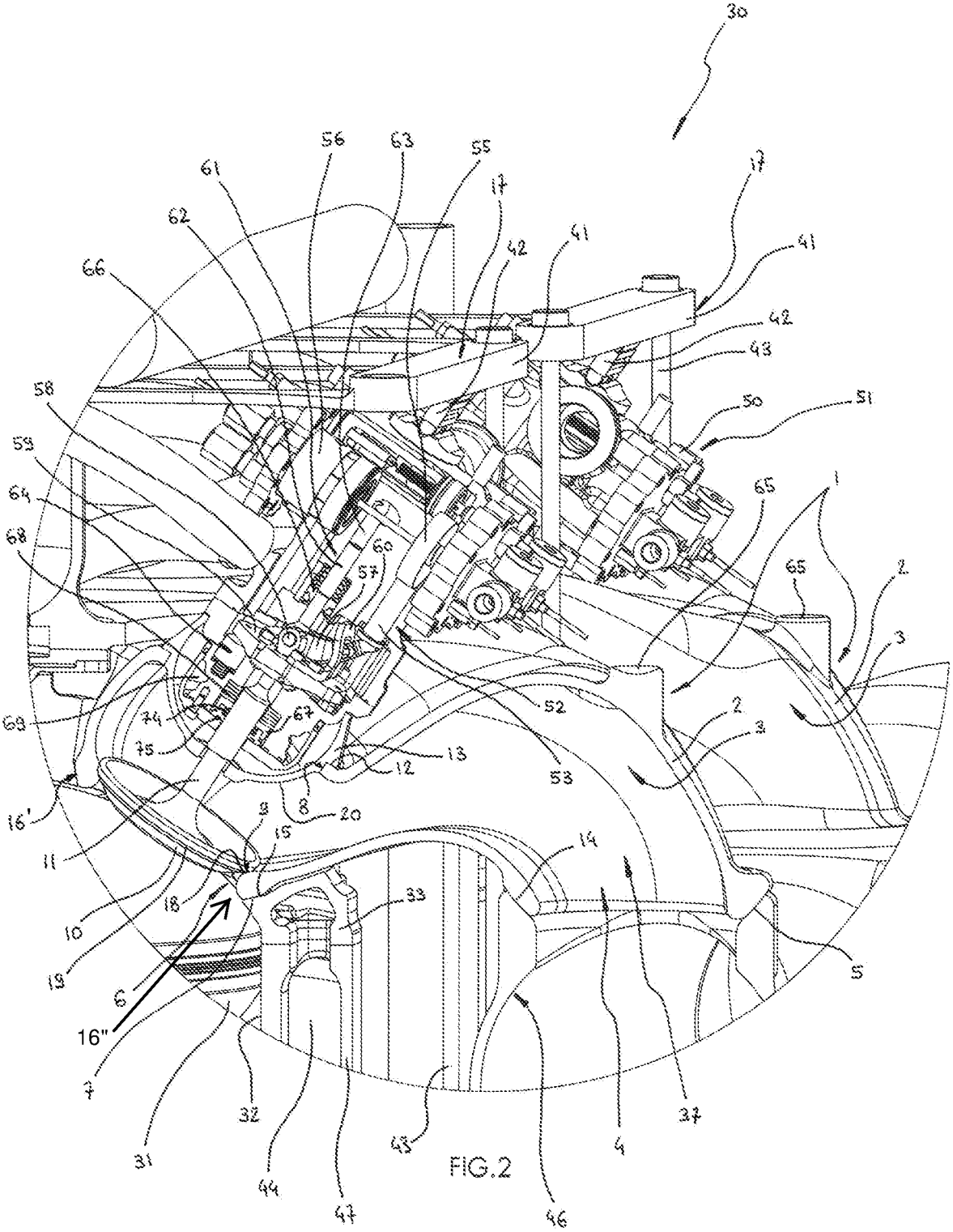
FIG. 2 is a three-dimensional view of the articulated plenum according to the invention, used on the transfer-expansion-regeneration combustion engine according to patent WO2016/120560 held by the applicant, said plenum accommodating a hydraulic regeneration valve actuator wherein the valve is rendered compatible with said plenum by various arrangements envisaged by the articulated plenum according to the invention.
Figure 3:
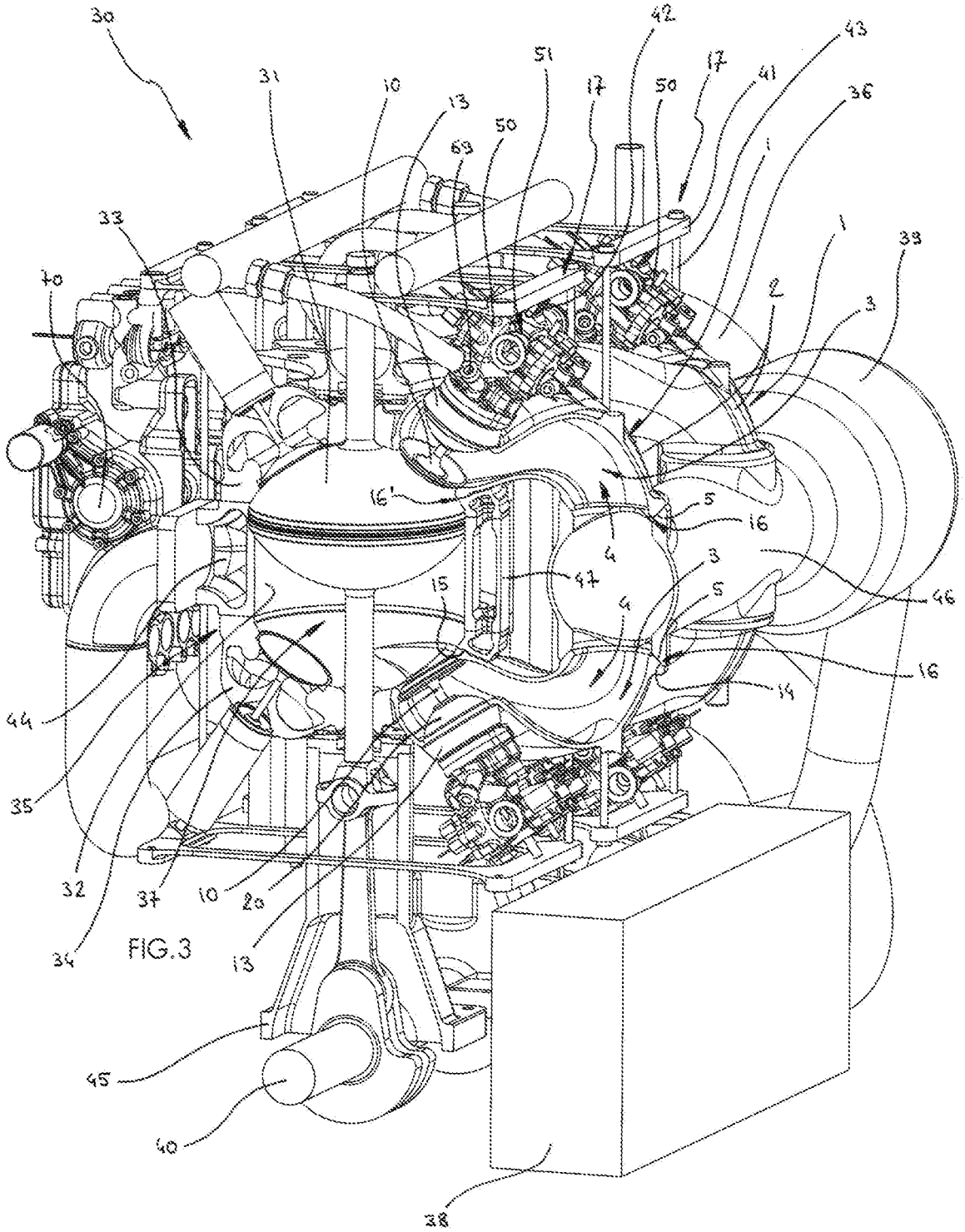
FIG. 3 is a three-dimensional overall view of a transfer-expansion-regeneration combustion engine according to patent WO2016/120560 held by the applicant which comprises two expansion cylinder-head assemblies, each assembly receiving two articulated plenums according to the invention.

In FIGS. 1 to 3, the articulated plenum 1, various details of the components thereof, the alternative embodiments thereof, and the accessories thereof are shown.

As illustrated in FIG. 3, the articulated plenum 1 is particularly envisaged for a transfer-expansion-regeneration combustion engine 30 wherein the dual-acting expansion piston 31 moves in an expansion cylinder 32, the latter forming with an upper expansion cylinder head 33 and a lower expansion cylinder head 34 an expansion cylinder-head assembly 35.

In FIG. 3 it is seen that the transfer-expansion-regeneration combustion engine 30 comprises a compressor 36 which compresses a working gas 37 before expelling same into a regeneration heat exchanger 38 wherein said gas 37 is preheated whereas on leaving said exchanger 38 said gas 37 is superheated by a heat source 39.

On leaving the heat source 39, the working gas 37 is introduced via a burner outlet pipe 46 followed by an intake pipe 3 and by an intake valve 10 controlled by an intake valve actuator 50 in the expansion cylinder 32 in order to be expanded therein and produce work on a power output shaft 40.

The working gas 37 is subsequently expelled from the expansion cylinder 32 prior to being reintroduced into the regeneration heat exchanger 38 in order to be cooled therein by transferring a portion of the heat thereof to the working gas 37 entering said exchanger 38 to be preheated therein.

As shown in FIGS. 1 to 3, the articulated plenum 1 according to the invention has a hollow plenum body 2 which can advantageously be made of a hard material resistant to high temperatures such as silicon carbide.

Said plenum body 2 forms the intake pipe 3 of the transfer-expansion-regeneration combustion engine 30 and comprises a plenum inlet orifice 4 which communicates with the heat source 39, a plenum outlet orifice 6 which opens into the expansion cylinder 32 via either the upper expansion cylinder head 33 or the lower expansion cylinder head 34, and an actuator orifice 8 which receives the intake valve actuator 50.

As particularly illustrated in FIGS. 1 and 2, the articulated plenum 1 according to the invention also has a frusto-spherical end on the burner side 5 provided at the level of the plenum inlet orifice 4, said end 5 forming a tight ball joint link 16 with a complementary frusto-spherical surface on the burner side 14 provided outside the burner outlet pipe 46, the latter being capable of being made of hard material resistant to high temperature such as silicon carbide.

It is noted that advantageously, either the frusto-spherical end on the burner side 5 or the complementary frusto-spherical surface on the burner side 14 can have a conical and not spherical shape, so as to favor a contact line rather than a contact area between said end 5 and said surface 14. It is noted that in this case, the female part must have a conical shape.

FIGS. 1 and 2 also illustrate that the articulated plenum 1 according to the invention also has a frusto-spherical end on the cylinder head side 7 provided at the level of the plenum outlet orifice 6, said end 7 forming a tight ball joint link 16' with a complementary frusto-spherical surface on the cylinder head side 15 provided outside the upper expansion cylinder head 33 or the lower expansion cylinder head 34.

It is noted that advantageously, the frusto-spherical end on the cylinder head side 7 or the complementary frusto-spherical surface on the cylinder head side 15 can have a conical and not spherical shape, so as to favor a contact line rather than a contact area between said end 7 and said surface 15. It is noted that in this case, the female part must have a conical shape.

The articulated plenum 1 according to the invention also comprises a valve seat 9 which is particularly visible in FIGS. 1 and 2, said seat 9 being provided in the vicinity of the plenum outlet orifice 6 whereas the intake valve 10 can rest on said seat 9 to close said orifice 6 so as to prevent the working gas 37 from the heat source 39 from entering the expansion cylinder 32.

It is noted that advantageously, the intake valve 10 can be made of a hard material resistant to high temperatures such as silicon carbide.

Finally and as shown in FIGS. 1 to 3, the articulated plenum 1 according to the invention includes a restraining system 17 which, on one hand, keeps the frusto-spherical end on the burner side 5 pressed against the complementary frusto-spherical surface on the burner side 14, and which, on the other, keeps the frusto-spherical end on the cylinder head side 7 pressed against the complementary frusto-spherical surface on the cylinder head side 15.

According to a particular embodiment of the articulated plenum 1 according to the invention, the valve seat 9 can have a complementary frusto-spherical surface on the seat side 18 which engages with a frusto-spherical bearing area on the valve side 19 provided at the end of the intake valve 10.

In this case, said surface 18 and said bearing area 19 form a tight ball joint link 16" when they are in contact with one another such that the intake valve 10 can be oriented in relation to the articulated plenum 1 according to a limited angle, while producing in all cases tightness with the valve seat 9 with which it engages.

It is noted that advantageously, the complementary frusto-spherical surface on the seat side 18 can be conical and not spherical so as to favor a contact line rather than a contact area between itself and the frusto-spherical bearing area on the valve side 19.

As shown clearly in FIGS. 1 and 2, the intake valve 10 can comprise a valve stem 11 which can move in translation along the longitudinal axis thereof in or with an upper valve stem guiding ball joint 66 housed in the intake pipe actuator 50, said ball joint 66 enabling said valve 10 to orient itself according to a limited angle in relation to said actuator 50.

According to this alternative embodiment, the valve stem 11 can move in translation along the longitudinal axis thereof in a position-memory valve stem seal-carrier 67 shown in FIGS. 1 and 2. Said seal-carrier 67 is housed in the intake valve actuator 50 and can move radially in relation to said actuator 50.

Said seal-carrier 67 can advantageously include a valve stem seal 74 which forms tightness between said seal-carrier 67 and the valve stem 11 whereas said seal-carrier 67 can also include a seal-carrier seal 75 which forms tightness between said seal-carrier 67 and the intake valve actuator 50.

It is observed in FIGS. 1 and 2 that the position-memory valve stem seal-carrier 67 can be kept pressed against the intake valve actuator 50 by a valve stem seal-carrier spring 68 which may consist of a stack of elastic washers, a helical spring, or any other type of spring known to those skilled in the art.

It is observed that the pressing load applied by said spring 68 on said seal-carrier 67 tends to hold the latter in position in relation to the intake valve actuator 50 by friction, without preventing same from moving when the valve stem 11 imparts a radial load of sufficient intensity thereon.

By way of alternative embodiment of the articulated plenum 1 according to the invention, it is shown in FIGS. 1 to 3 that the plenum body 2 can receive the intake valve actuator 50 via a thermal decoupling spacer 13 which produces tightness and centering with the plenum body 2, on one hand, and with the intake valve actuator 50, on the other. Advantageously, the thermal decoupling spacer 13 is made of a low thermal conductivity material such as zirconium oxide.

It is observed—particularly in FIGS. 1 and 2—that the lower part of the thermal decoupling spacer 13 can form a thermal spacer screen 20 which protects the intake valve actuator 50 from the heat emitted by the working gas 37, the latter circulating at high temperature in the intake pipe 3 formed by the plenum body 2.

It is noted that the thermal protection of the intake valve actuator 50 formed by the thermal spacer screen 20 can be added to or replace an actuator body cooling circuit 69 particularly visible in FIGS. 1 and 2, that can be included in the intake valve actuator 50 in the lower part thereof.

In FIGS. 1 to 3, it is shown that the restraining system 17 can include at least one actuator restraining plate 41 kept pressed against the intake valve actuator 50 by at least one plate tie rod 43 and via at least one plate abutment 42.

Thus, the intake valve actuator 50 is kept pressed against the plenum body 2 by an actuator bearing face 12 of the actuator orifice 8, whereas the frusto-spherical end on the burner side 5 is kept pressed against the complementary frusto-spherical surface on the burner side 14 and/or the frusto-spherical end on the cylinder head side 7 is kept pressed against the complementary frusto-spherical surface on the cylinder head side 15.

As shown in FIGS. 1 to 3, it is observed that the plate abutment 42 can be fixed or articulated, or consist of one or more intercalated or juxtaposed parts. It is further observed in FIG. 3 that two actuator restraining plates 41 can be interconnected by plate tie rods 43, the first said plate 41 keeping a first intake valve actuator 50 pressed against a first articulated plenum 1 engaging with the upper expansion cylinder head 33 whereas the second said plate 41 keeps a second intake valve actuator 50 pressed against a second articulated plenum 1 engaging with the lower expansion cylinder head 34.

FIG. 1 shows that the restraining system 17 can also include at least one plenum restraining vise on the burner side 71 which presses directly or indirectly—in the vicinity of the plenum inlet orifice 4 and in the direction thereof—on the plenum body 2 via at least one vise bearing surface 65.

It is noted that it can be envisaged that the same plenum restraining vise on the burner side 71 simultaneously presses the respective frusto-spherical ends on the burner side 5 of two articulated plenums 1 against the complementary frusto-spherical surfaces on the burner side 14 with which they engage, the first articulated plenum 1 engaging with the upper expansion cylinder head 33 whereas the second articulated plenum 1 engages with the lower expansion cylinder head 34.

As illustrated particularly in FIG. 1, it is observed that the restraining load applied by the plenum restraining vise on the burner side 71 on the articulated plenum(s) 1 with which it engages can advantageously be set using a vise load setting nut 73 which comprises a plenum restraining vise spring 72.

Operation of the Invention

The operation of the articulated plenum 1 according to the invention is readily understood in the light of FIGS. 1 to 3.

To detail said operation, the articulated plenum 1 is shown in FIGS. 1 to 3 as it can be used on the transfer-expansion-regeneration combustion engine 30 according to patent WO2016/120560 held by the applicant, which is herein enhanced in that it consists of a dual-acting expansion cylinder with adaptive support as described in patent WO2017/046479 also held by the applicant and which allows the expansion cylinder-head assembly 35 of said engine 30 to expand freely under the effect of temperature.

It is also observed in FIGS. 1 to 3 that the transfer-expansion-regeneration combustion engine 30 receives the regenerative cooling system according to patent WO2018/154214 also held by the applicant, envisaged by way of enhancement of said engine 30.

Thus, in FIGS. 1 to 3, the presence of a cooling chamber 47 and a gas flow space 44 will be noted, these members 47, 44 being features of the regenerative cooling system according to patent WO2018/154214.

FIG. 3 is a general view of the transfer-expansion-regeneration combustion engine 30 as it can be envisaged to receive the articulated plenum 1 according to the invention.

In said FIG. 3, the dual-acting expansion piston 31 is observed, which can move in longitudinal translation in an expansion cylinder 32 wherein the upper end is closed by an upper expansion cylinder head 33 whereas the lower end thereof is closed by a lower expansion cylinder head 34. Thus, said cylinder 32 forms with said cylinder heads 33, 34 an expansion cylinder-head assembly 35.

It is noted in FIG. 3 that the transfer-expansion-regeneration combustion engine 30 comprises a compressor 36 which compresses a working gas 37. Said gas 37 is intended to be expanded in the expansion cylinder 32 after being preheating in a regeneration heat exchanger 38, then superheated by a heat source 39 which, in this instance and according to the non-limiting example disclosed herein to illustrate the operation of the articulated plenum 1 according to the invention, is a burner known per se.

On expanding, the working gas 37 produces on the dual-acting expansion piston 31 mechanical work which is transmitted to a power output shaft 40 housed in a transmission casing 45.

It is observed that the working gas 37 is conveyed from the heat source 39 to the expansion cylinder 32 successively via a burner outlet pipe 46 then via the intake pipe 3 formed by the plenum body 2 of the articulated plenum 1 according to the invention.

In FIGS. 1 to 3, the intake valve actuator 50 is observed which controls the intake valve 10 and which is none other than a hydraulic regeneration valve actuator 51 as described in French patent application No. 1759206 of 2 Oct. 2017 held by the applicant. In FIG. 3, the hydraulic closure-regeneration engine 70 described in said patent application.

Particularly in FIGS. 1 and 2, the main constituents of the hydraulic regeneration valve actuator 51 described by French patent application No. 1759206 can be seen. These constituents include an actuator jack 52 which comprises an actuator jack piston 53 to form a hydraulic actuator chamber 54. The introduction of a hydraulic fluid into said hydraulic chamber 54 or the expulsion thereof from said chamber 54 is carried out according to this non-limiting example of an embodiment by means of tubular hydraulic valves 55 controlled by a solenoid valve actuator 56.

It is observed that the actuator jack piston 53 acts upon the valve stem 11 of the intake valve 10 via a valve lifting cam lever 57 which is connected to said valve stem 11 via a cam lever pivot link 58.

The valve lifting cam lever 57 rests on a cam lever rolling-sliding plate 59 with which it reacts to lift or rest the intake valve 10.

It is noted that a cam lever orientation arch 60 can advantageously retain the orientation thereof on the valve lifting cam lever 57 along an axis parallel with the valve stem 11.

FIGS. 1 and 2 also show the valve return jack 61 which returns the intake valve 10 to the seat thereof, said jack 61 particularly consisting of a valve return jack piston 62 to form a hydraulic valve return jack chamber 63.

Below the cam lever rolling/sliding plate 59, the play compensation jack 64 is also observed, which compensates for the deformations and expansions of the various components forming the hydraulic regeneration valve actuator 51, to provide the latter with suitable operation regardless of the mechanical and thermal stress to which it is subjected.

We will assume herein that the expansion cylinder-head assembly 35 is kept at a temperature of seven hundred degrees Celsius by the cooling chamber 47 envisaged by the regenerative cooling system according to patent WO2018/154214, whilst the working gas 37 leaves the heat source 39 at a temperature of one thousand three hundred degrees Celsius.

We will also assume that advantageously and thanks to said regenerative cooling system, the expansion cylinder-head assembly 35 is made of cast iron, a material known to be used in motorization, whether the latter is for example intended for a motor vehicle, a truck or a vessel.

We will also assume herein that the burner outlet pipe 46 and the plenum body 2 of the articulated plenum 1 according to the invention are made of silicon carbide wherein the operating temperature is equal to that of the working gas 37 leaving the heat source 39, i.e. one thousand three hundred degrees Celsius according to the non-limiting example taken herein.

The intake valve 10 for its part is herein made of silicon nitride in the case of the part thereof closest to the valve seat 9 with which it engages, and of steel in the case of the part of the valve stem 11 thereof entering inside the intake valve actuator 50 and which engages with the valve lifting cam lever 57.

It will be noted that the part of the intake valve 10 which is made of silicon nitride is heated in operation to a temperature essentially close to one thousand three hundred degrees Celsius, whereas the part of the valve stem 11 which is made of steel is heated in operation to a temperature essentially close to one hundred degrees Celsius. It can be specified herein that the part of the valve stem 11 made of steel is advantageously mounted shrunk onto the part of said stem 11 made of silicon nitride.

It is understood that when the expansion cylinder-head assembly 35 expands under the effect of the operating temperature thereof which is approximately seven hundred degrees Celsius, and the plenum body 2 and the burner outlet pipe 46 do the same when they are subjected to a temperature of the order of one thousand three hundred degrees Celsius, the distance separating the frusto-spherical end on the burner side 5 from the frusto-spherical end on the cylinder head side 7 of the same articulated plenum 1 increases.

This applies for each articulated plenum 1 as represented in FIG. 3. It is readily inferred from this increase in distance and from the various expansions described above that the orientation of said articulated plenums 1 varies in relation to the upper expansion cylinder head 33 or the lower expansion cylinder head 34 with which they engage, on one hand, and in relation to the burner outlet pipe 46 to which they are tightly connected, on the other.

This variation of relative orientation of said plenums 1 is enabled by the articulated plenum 1 according to the invention thanks to the frusto-spherical end on the burner side 5 which forms a first tight ball joint link 16 with the complementary frusto-spherical surface on the burner side 14 facing same. Said variation is enabled thanks to the frusto-spherical end on the cylinder head side 7 which forms a second tight ball joint link 16' with the complementary frusto-spherical surface on the cylinder head side 15 also facing same.

Thus, the articulated plenum 1 according to the invention adapts automatically to variations in the distance between the upper expansion cylinder head 33 and the lower expansion cylinder head 34, and between said cylinder heads 33, 34 and the burner outlet pipe 46 to which they are connected via the plenum body 2 with which they engage.

It is observed in FIG. 3 that the four intake valve actuators 50 comprised by the transfer-expansion-regeneration combustion engine 30 are each borne by a plenum body 2 whereon said actuators 50 each rest via an actuator bearing face 12 contained in the actuator orifice 8 with which they engage.

It is observed in FIGS. 1 to 3 that a thermal decoupling spacer 13 is inserted advantageously between the intake valve actuator 50 and the plenum body 2 bearing same.

The thermal decoupling spacer 13 is according to this non-limiting example made of a low thermal conductivity material such as zirconium oxide, whereas the lower part thereof forms a thermal spacer screen 20 which protects the intake valve actuator 50 from the heat emitted by the working gas 37 which circulates at high temperature in the intake pipe 3 formed by the plenum body 2.

It is observed in FIGS. 1 and 2 that to the thermal protection of the intake valve actuator 50 formed by the thermal spacer screen 20 is added an actuator body cooling circuit 69 wherein a heat transfer fluid circulates, such as a mixture of water and glycol kept at a temperature of approximately one hundred degrees Celsius.

In FIGS. 1 to 3, the restraining system is 17 shown, which makes it possible, on one hand, to keep the intake valve actuator 50 pressed tightly against the plenum body 2 with which it engages, and, on the other, to keep the frusto-spherical end on the cylinder head side 7 pressed against the complementary frusto-spherical surface on the cylinder head side 15 with which said end 7 engages, while keeping the frusto-spherical end on the cylinder head side 5 pressed against the complementary frusto-spherical surface on the burner side 14 with which said end 5 engages.

In FIGS. 1 to 3, it is observed that the restraining system 17 which keeps the intake valve actuator 50 pressed against the plenum body 2, on one hand, and the frusto-spherical end on the cylinder head side 7 against the complementary frusto-spherical surface on the cylinder head side 15, on the other, includes an actuator restraining plate 41 which applies a pressing load on the intake valve actuator 50 in the direction of the plenum body 2 via a plate abutment 42 which is herein articulated and consists of several intercalated parts.

It is observed in FIG. 3 that two actuator restraining plates 41 are interconnected by tie rods 43, the first said plate 41 keeping a first intake valve actuator 50 pressed against a first articulated plenum 1 engaging with the upper expansion cylinder head 33 whereas the second said plate 41 keeps a second intake valve actuator 50 pressed against a second articulated plenum 1 engaging with the lower expansion cylinder head 34.

In FIG. 1, it is observed that the restraining system 17 also includes a plenum restraining vise on the burner side 71 which presses—in the vicinity of the plenum inlet orifice 4 and in the direction thereof—on the plenum body 2 via at least one vise bearing surface 65 which herein takes the form of a ball joint link.

Advantageously, the same plenum restraining vise on the burner side 71 simultaneously presses the respective frusto-spherical ends on the burner side 5 of the two articulated plenums 1 included in the same expansion cylinder-head assembly 35 against the complementary frusto-spherical surfaces on the burner side 14 with which they engage, the first articulated plenum 1 engaging with the upper expansion cylinder head 33 whereas the second articulated plenum 1 engages with the lower expansion cylinder head 34.

As illustrated in FIG. 1, the restraining load applied by the plenum restraining vise on the burner side 71 on the articulated plenums 1 with which it engages is herein and according to this non-limiting example adjustable by means of a vise load setting nut 73, the latter compressing a plenum restraining vise spring 72 which ensures a small variation of the pressing load applied by the plenum restraining vise on the burner side 71 on the articulated plenums 1 with which it engages regardless of the expansion of the various components gripped by said vise 71.

In the same way as the expansion cylinder-head assembly 35, the articulated plenums 1 and the burner outlet pipe 46 with which said assembly 35 engages expand, the thermal decoupling spacer 13 and the end made of silicon nitride of the intake valve 10 expand in all directions, or even warp under the effect of mechanical and thermal stress.

Furthermore, the manufacturing tolerances of the various components 35, 1, 46, 13, 10 listed above mean that the positioning of the intake valve actuator 50 in relation to that of the valve seat 9 provided at the level of the plenum outlet orifice 6 varies according to the operating conditions of the transfer-expansion-regeneration combustion engine 30.

For all that, it is necessary to ensure that the intake valve 10 still rests suitably and tightly on the valve seat 9 which is—according to the non-limiting example taken herein to illustrate the operation of the articulated plenum 1 according to the invention—embodied inside the plenum body 2.

The relative position of the intake valve actuator 50 in relation to that of the valve seat 9 being variable, the articulated plenum 1 according to the invention envisages that the valve seat 9 has a complementary frusto-spherical surface on the seat side 18 which is herein envisaged as conical, said surface 18 engaging with a frusto-spherical bearing area on the valve side 19 provided at the end of the intake valve 10 such that the latter can be oriented in relation to the articulated plenum 1 according to a limited angle, while producing in all cases tightness with the valve seat 9 with which it engages.

For this reason, the valve stem 11 of the intake valve 10 engages with an upper valve stem guiding ball joint 66 provided in the intake valve actuator 50, said stem 11 being capable of moving in translation along the longitudinal axis thereof in said ball joint 66 whereas the latter enables said valve 10 to be oriented according to a limited angle in relation to the intake valve actuator 50 controlling same.

Furthermore, FIGS. 1 and 2 show that the valve stem 11 can move in translation along the longitudinal axis in the position-memory valve stem seal-carrier 67 which is provided in the intake valve actuator 50.

The position-memory valve stem seal-carrier 67 can move radially in relation to said actuator 50 when the valve stem 11 applies a radial load thereon. It is observed in FIGS. 1 and 2 that said seal-carrier 67 includes, on one hand, a valve stem seal 74 which forms tightness between itself and the valve stem 11 and, on the other, a seal-carrier seal 75 which forms tightness between said seal-carrier 67 and the intake valve actuator 50.

In FIGS. 1 and 2, it is observed that the position-memory valve stem seal-carrier 67 is kept pressed against the intake valve actuator 50 by a valve stem seal-carrier spring 68 which herein consists of a stack of elastic washers.

It is observed that the pressing load applied by said spring 68 on said seal-carrier 67 tends to hold the latter in position in relation to the intake valve actuator 50 by friction, without preventing same from moving when the valve stem 11 imparts a radial load of sufficient intensity thereon.

The device for reorienting the intake valve 10 formed by all of the means described above enables the plenum body 2 to warp and expand, the end made of silicon nitride of the intake valve 10 to elongate, and the play found, on one hand, between the thermal decoupling spacer 13 and the intake valve actuator 50 and, on the other, between said spacer 13 and the actuator orifice 8 to be compensated without ever compromising the tightness formed by the intake valve 10 with the valve seat 9 with which it engages.

Indeed, when due to expansions, deformations or compensation of play, the intake valve 10 after opening is no longer situated exactly in the axis of the valve seat 9 with which it engages, on the closure of said valve 10 only one side of the frusto-spherical bearing area thereof on the valve side 19 abuts first on the valve seat 9 which in this instance is conical.

The intake valve 10 continuing the closure thereof, the cone formed by the valve seat 9 returns the frusto-spherical bearing area on the valve side 19 to the center of said seat 9 as the intake valve 10 is closed.

In doing so, the valve stem 11 applies a radial load on the position-memory valve stem seal-carrier 67 such that the latter moves radially in relation to the intake valve actuator 50, which is authorized by the upper valve stem guiding ball joint 66.

On the subsequent opening of the intake valve 10, as the pressing load applied by the valve stem seal-carrier spring 68 on the position-memory valve stem 67 brakes the latter in relation to the intake valve actuator 50, said seal-carrier 67 retains the orientation of the intake valve 10 in relation to said actuator 50 until the subsequent closure of said valve 10.

Thus, the intake valve 10 is still kept stepwise in the axis of the valve seat 9 with which it engages, without preventing the various constituent parts of the articulated plenum 1 according to the invention or the transfer-expansion-regeneration combustion engine 30 from warping and/or expanding freely, according to the operating stress of said engine 30.

It is further noted that this strategy of keeping the intake valve 10 in the correct orientation is advantageously combined with the play compensation carried out by the play compensation jack 64, said play compensation being specifically described in French patient application No. 1759206 of 2 Oct. 2017 held by the applicant.

The possibilities of the articulated plenum 1 according to the invention are not limited to the applications described above and it should further be understood that the description above has merely been given by way of example and that it in no way limits the scope of said invention which would still apply if replacing the execution details described by any other equivalent.

The invention claimed is:

1. An articulated plenum for a transfer-expansion-regeneration combustion engine in which a dual-acting expansion piston is configured to move in an expansion cylinder, the expansion cylinder forming an expansion cylinder-head assembly with an upper expansion cylinder head and a lower expansion cylinder head, said transfer-expansion-regeneration combustion engine including a compressor which compresses a working gas before expelling the working gas into a regeneration heat exchanger in which said working gas is preheated and on leaving said regeneration heat exchanger, said working gas is superheated by a heat source before entering a burner outlet pipe and an intake pipe and then into the expansion cylinder by an intake valve controlled by an intake valve actuator in order to be expanded therein and produce work on a power output shaft, said working gas being subsequently expelled from the expansion cylinder prior to being reintroduced into the regeneration heat exchanger in order to be cooled therein by transferring a portion of the heat thereof to the working gas entering said exchanger to be preheated therein, said articulated plenum comprising:

a hollow plenum body forming the intake pipe and comprising a plenum inlet orifice which communicates with the heat source, a plenum outlet orifice which opens into the expansion cylinder via either the upper expansion cylinder head or the lower expansion cylinder head, and an actuator orifice which receives the intake valve actuator;

a first frusto-spherical end on a burner side provided at a level of the plenum inlet orifice, said first frusto-spherical end forming a first tight ball joint link with a first complementary frusto-spherical surface on the burner side provided outside the burner outlet pipe;

a second frusto-spherical end on a cylinder head side provided at a level of the plenum outlet orifice, said second frusto-spherical end forming a second tight ball joint link with a second complementary frusto-spherical surface on the cylinder head side provided outside the upper expansion cylinder head or the lower expansion cylinder head;

a valve seat provided in the vicinity of the plenum outlet orifice, the intake valve being configured to rest on said seat to close said orifice; and a restraining system configured to keep the first frusto-spherical end on the burner side pressed against the first complementary frusto-spherical surface on the burner side, and to keep the second frusto-spherical end on the cylinder head side pressed against the second complementary frusto-spherical surface on the cylinder head side.

2. The articulated plenum according to claim 1, wherein the valve seat has a complementary frusto-spherical surface on a seat side which engages with a frusto-spherical bearing area on a valve side provided at an end of the intake valve, said complementary frusto-spherical surface and said frusto-spherical bearing area forming a third tight ball joint link when the complementary frusto-spherical surface and said frusto-spherical bearing area are in contact with one another.

3. The articulated plenum according to claim 2, wherein the intake valve comprises a valve stem configured to move in translation along the longitudinal axis thereof in or with an upper valve stem guiding ball joint housed in the intake valve actuator, said upper valve stem guiding ball joint enabling said intake valve to orient at an angle relative to said intake valve actuator.

4. The articulated plenum according to claim 3, wherein the valve stem is configured to move in translation along the longitudinal axis thereof in a position-memory valve stem seal-carrier which is housed in the intake valve actuator, said position-memory valve stem seal-carrier being configured to move radially in relation to said intake valve actuator, the position-memory valve stem seal-carrier including a valve stem seal which forms tightness between said position-memory valve stem seal-carrier and the valve stem, and a seal-carrier seal which forms tightness between said position-memory valve stem seal-carrier and the intake valve actuator.

5. The articulated plenum according to claim 4, wherein the position-memory valve stem seal-carrier is kept pressed against the intake valve actuator by a valve stem seal-carrier spring.

6. The articulated plenum according to claim 1, wherein the plenum body receives the intake valve actuator via a thermal decoupling spacer which produces tightness, the thermal decoupling spacer centering with the plenum body, and the intake valve actuator.

7. The articulated plenum according to claim 1, wherein the restraining system comprises at least one actuator restraining plate pressed against the intake valve actuator by at least one plate tie rod and via at least one plate abutment, such that said actuator is pressed against the plenum body via an actuator bearing face contained in the actuator orifice, and such that the first frusto-spherical end on the burner side is pressed against the first complementary frusto-spherical surface on the burner side and/or the second frusto-spherical end on the cylinder head side is pressed against the second complementary frusto-spherical surface on the cylinder head side.

8. The articulated plenum according to claim 1, wherein the restraining system comprises at least one plenum restraining vise on the burner side which presses directly or indirectly, in the vicinity of the plenum inlet orifice and in the direction thereof, on the plenum body via at least one vise bearing surface.

* * * * *